US005331741A

United States Patent [19]

Taylor, Jr.

[11] Patent Number: 5,331,741

[45] Date of Patent: Jul. 26, 1994

[54] LEVER-ACTUATED FOLDING KNIFE

[76] Inventor: William J. Taylor, Jr., 109 Teal Ct., Norcross, Ga. 30076

[21] Appl. No.: 927,595

[22] Filed: Aug. 10, 1992

[51] Int. Cl.[5] ..... B26B 3/06

[52] U.S. Cl. ..... 30/158; 30/160; 30/161

[58] Field of Search ..... 30/158, 159, 160, 161

[56] References Cited

U.S. PATENT DOCUMENTS

| | | | |
|---|---|---|---|
| 249,896 | 11/1881 | Chamberlain | 30/158 |
| 698,080 | 4/1902 | Treas | 30/159 |
| 1,234,345 | 7/1917 | Keeran | 30/158 |
| 1,431,835 | 10/1922 | Neft | 30/160 |
| 1,553,985 | 9/1925 | Ciesnierski | 30/162 |
| 1,603,914 | 10/1926 | Hermann | 30/159 |
| 1,647,405 | 11/1927 | Giesen | 30/160 |
| 2,199,430 | 5/1940 | Greve | 30/158 |
| 2,416,277 | 2/1947 | Siegel | 30/158 |
| 2,601,999 | 7/1952 | Sly | 30/158 |
| 2,808,646 | 10/1957 | Lohr, Jr. et al. | 30/159 |
| 4,177,560 | 12/1979 | Sakurai | 30/160 |
| 4,719,700 | 1/1988 | Taylor | 30/158 |
| 4,805,303 | 2/1989 | Gibbs | 30/161 |
| 4,893,409 | 1/1990 | Poehlmann | 30/161 |
| 5,044,079 | 9/1991 | Gibbs | 30/160 |

FOREIGN PATENT DOCUMENTS

| | | | |
|---|---|---|---|
| 28764 | 10/1884 | Fed. Rep. of Germany | 30/161 |
| 344986 | 12/1921 | Fed. Rep. of Germany | 30/159 |
| 22620 | 12/1898 | United Kingdom | 30/158 |
| 186607 | 9/1922 | United Kingdom | 30/159 |

OTHER PUBLICATIONS

"Noncircular Gears", Cunningham Industries, Inc.

*Primary Examiner*—Richard K. Seidel
*Assistant Examiner*—Hwei-Siu Payer
*Attorney, Agent, or Firm*—Jones & Askew

[57] ABSTRACT

A folding knife designed to be easily opened with one hand and having a thumb-actuated opening lever to pivot the blade from closed to opened positions. The thumb-actuated lever in a first preferred embodiment has an opening lever driving a sector gear that engages a drive gear for opening the blade. The opening lever remains within the plan-view outline of the knife body at all times. In another disclosed embodiment, the opening lever drives a cam which, in turn, causes a second lever to pivot within the body of the knife. Gear teeth on this second lever engage and rotate a blade drive gear, causing the blade to pivot between closed and opened positions. The opening lever in still another disclosed embodiment includes a thumb-operated slider having a cam surface engaging a follower to pivot a blade opening lever.

18 Claims, 7 Drawing Sheets

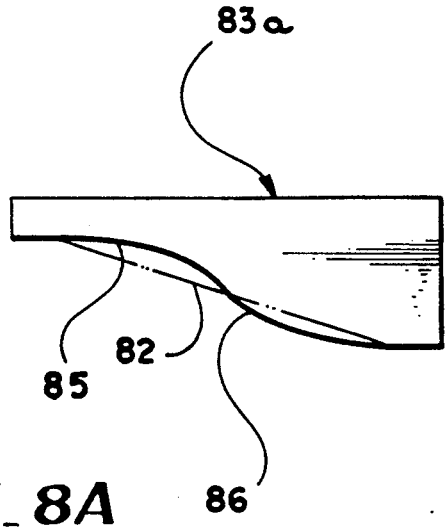
Fig. 8A
Fig. 12A
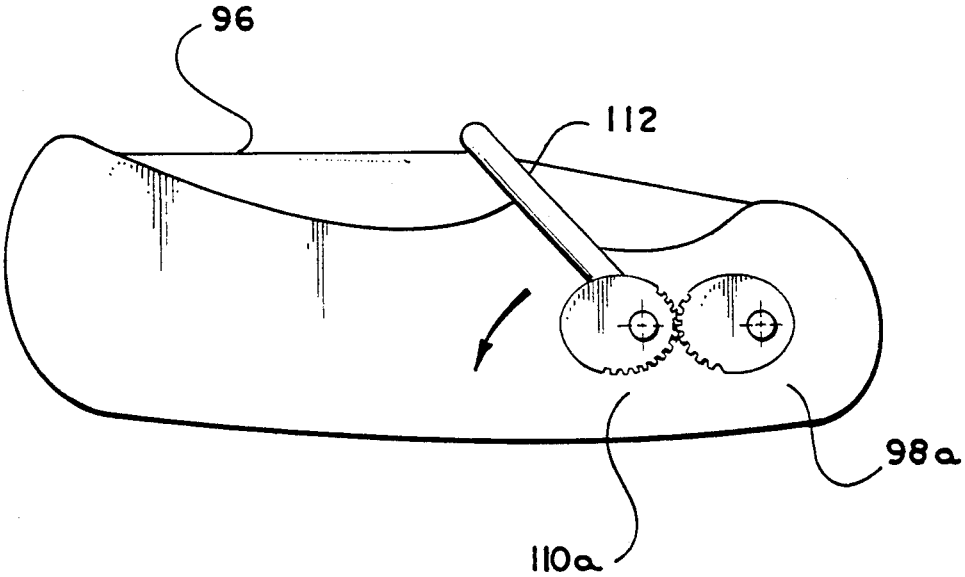

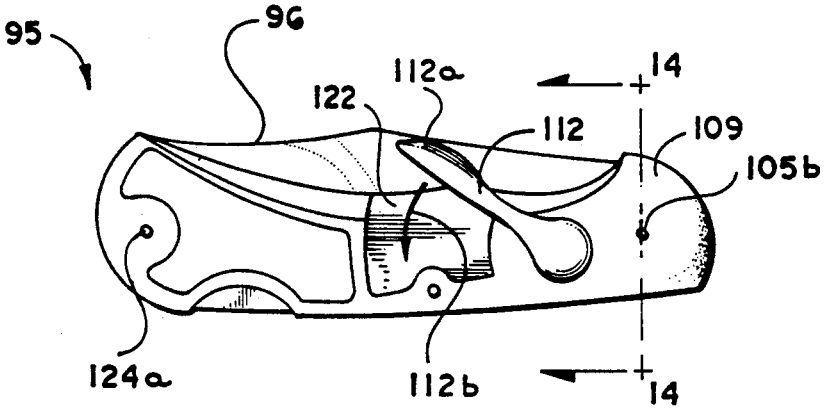
Fig. 12
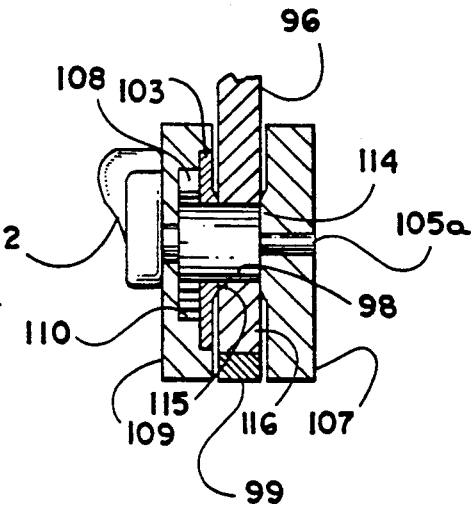
Fig. 14
Fig. 15
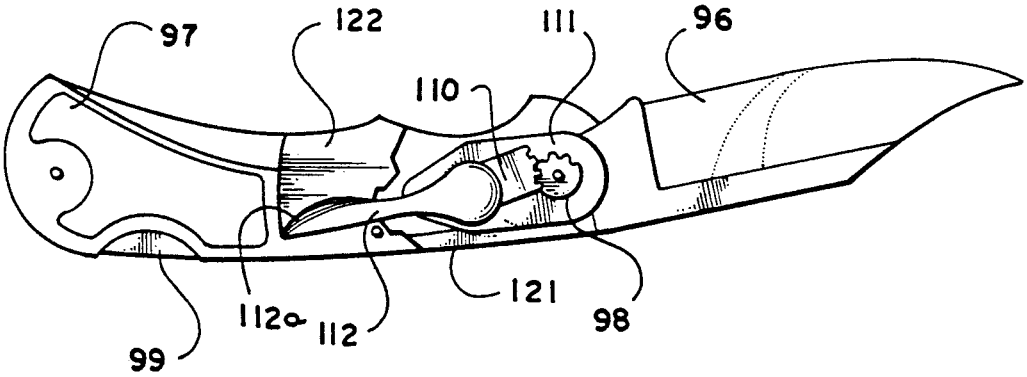

LEVER-ACTUATED FOLDING KNIFE

FIELD OF INVENTION

This invention relates in general to knives, and relates in particular to a folding knife equipped with a mechanical device for unfolding or opening the blade.

BACKGROUND OF THE INVENTION

The traditional folding knife, sometimes also known as a pocket knife, has one or more blades pivotably mounted within a housing or casement. To prevent accidental opening of the knife, each blade typically is biased in the closed position by a mechanism such as a spring or detent. To open the blade, the user must insert the thumbnail of one hand into a notch or groove provided for that purpose near the back edge of the blade, and manually rotate the blade around its pivot point at one end of the knife body while holding the body with the other hand. This opening technique can be difficult to accomplish, particularly for those having short thumbnails or for a handicapped person who may not have full use of both hands, or with knives whose blade pivot mechanism is relatively stiff. Women, who customarily have longer fingernails than men, are hesitant to use a pocket knife because they are apt to damage or break the thumbnail used to open the blade. Moreover, it is essential in some jobs, such as commercial fisherman and paratrooper, to open and use a knife with one hand while the other hand is otherwise occupied.

Folding knives with various mechanisms for opening or assisting with opening the blade are known in the art. For example, U.S. Pat. No. 249,896 discloses a knife equipped with a handle for unloading the spring force that normally keeps the blade closed. The blade also has the conventional thumbnail notch; the user, after first manipulating the handle to remove spring force from the blade, must then open the blade using the thumbnail notch as usual. This arrangement appears relatively awkward to implement, because the user must grasp the knife in one hand while manipulating the handle with the other hand, and then use the thumb and forefinger of that other hand to pivot the blade outwardly from the handle.

The so-called switchblade knife, where the closed blade is under spring tension and opens at the touch of a button, is illegal in many jurisdictions. Furthermore, the side-opening switchblade requires a safety device, usually a sliding button, so that the knife will not open accidentally in one's pocket. This safety must be manually moved to the off position prior to opening the knife, so that one must initially position the knife in one hand to operate the safety and then reposition the knife to press the button which releases the spring-tensioned blade. This is a time-consuming and awkward movement.

U.S. Pat. No. 22,620 discloses a folding knife with a handle directly connected to the pin which pivotably mounts the blade in the handle. U.S. Pat. No. 2,416,277 shows a pocket knife having a rack-and-pinion arrangement for opening or closing the blade when a sliding bar is moved longitudinally along the blade housing. These arrangements, in common with the first-mentioned prior patent, have various practical disadvantages, among which is the need for using two hands when opening the blade.

U.S. Pat. No. 4,719,700 by the present inventor discloses a folding knife designed for opening a blade by moving an actuator button longitudinally along the blade housing. This arrangement represents a step forward in the art, as it allows the user to open the knife with only one hand. However, the operating mechanisms employed with the knife disclosed in that patent required a considerable amount of straight-line force applied to the sliding actuator, particularly when overcoming the inertia of the blade at rest. Furthermore, a knife using the rack and pinion drive disclosed in that patent would be much thicker than the conventional pocket knife and would be less appealing in appearance.

SUMMARY OF INVENTION

Stated in somewhat general terms, a folding knife according to the present invention has a knife blade mounted in a body for pivotable movement between closed and open positions, in response to operation of a manual actuation lever. The actuation lever is located on a side of the body in position for one-handed operation by the thumb of a hand holding the knife, so that the knife is openable with only one hand. The actuation lever is coupled to the knife blade through a drive mechanism that transfers motion of the lever to the amount of pivoting movement required to open the knife blade.

Stated in greater detail, one disclosed embodiment of the present knife includes a blade opening lever mounted for movement on a first axis relative to the body of the knife, and operatively interconnected with the knife blade so that movement of the blade opening lever over a predetermined arc moves the blade between closed and opened positions. A separate manual actuation lever is coupled to move the blade opening lever over the predetermined arc, so as to open the blade from its closed position whenever the actuation member is manually displaced by a person holding the knife. The actuation lever includes an engagement member preferably located in position beneath the thumb of a person holding the knife in only one hand, so that the thumb can move the actuation member to open the knife blade. The actuation member preferably is mounted for pivotable movement on an axis separate from the axis of movement of the blade opening lever.

Stated with somewhat greater specificity, the present invention in some embodiments includes a cam displaced by movement of the actuation lever and engaging a cam track associated with the blade opening lever. The cam moves along the cam track as the actuation lever is manually displaced, especially by thumb pressure as described above, thereby moving the opening lever over its predetermined arc of travel and thereby pivoting the blade from closed to opened position. The shape of the cam or the cam track, or of both those elements, can be selected so as to produce a relatively greater mechanical advantage at the outset of movement of the actuation lever, thereby producing relatively greater torque to overcome the resting inertia of the blade while maintaining an acceptably-small total arc of movement for the actuation lever. The cam preferably is spaced apart from the pivoting axis of the actuation lever by a lesser amount than the manual engagement member, thereby adding to the mechanical advantage imparted to the cam when manually pivoting the actuation member.

Stated in further detail, the cam in one preferred embodiment comprises a beating portion journaled in the body of the knife and pivotable with the actuation lever. The cam further comprises an eccentric portion engaging the cam track to move the blade operating lever as the beating portion is rotated by the actuation member.

Stated in further detail with regard to another preferred embodiment, the actuation lever is a slider movable along a linear path by the thumb of the hand holding the knife and the cam comprises a surface of the slider. That cam surface engages a follower as the slider is manually moved along the linear path, and the slider actuates a blade opening lever to move the blade from closed to open positions. The cam track may be linear or nonlinear, the latter configuration preferably configured to provide an increased mechanical advantage during an initial travel of the blade from the closed position.

In still another preferred embodiment, the blade is connected to a driven member, such as a pinion, coupled to a drive member rotatable by a manual actuation lever. That lever is located for engagement by the thumb of a person holding the knife, so that the blade can be opened with only that one hand.

Accordingly, it is an object of the present invention to provide an improved folding knife.

It is another object of the present invention to provide an improved lever-actuated folding knife.

It is yet another object of the present invention to provide an improved pocket knife openable with one hand.

It is still another object of the present invention to provide a pocket knife having a unique mechanism for transmitting energy from an opening lever to the blade.

It is a further object of the present invention to provide a folding knife openable by a manually-actuated lever pivotable on an axis in relation to the body of the knife.

It is another object of the present invention to provide a knife that opens faster than a conventional side-opening switchblade knife because there is no need for a safety mechanism to disengage before opening the knife.

Other objects and advantages of the present invention will become more apparent from the following description of a preferred embodiment.

BRIEF DESCRIPTION OF DRAWINGS

FIG. 8A shows a modification of the opening slider in the embodiment of FIG. 8.

FIG. 12 is a side view of a lever-actuated folding knife in fully-closed position, according to a preferred third embodiment of the present invention.

FIG. 12A is a schematic side view showing a modification of the gear drive in the embodiment of FIG. 12.

FIG. 14 is a sectioned end view of the knife taken on line 14—14 of FIG. 12, with the blade partly open.

FIG. 15 is a partially broken-away side view as in FIG. 12, showing the blade fully opened.

DETAILED DESCRIPTION OF PREFERRED EMBODIMENT

Figure 1:
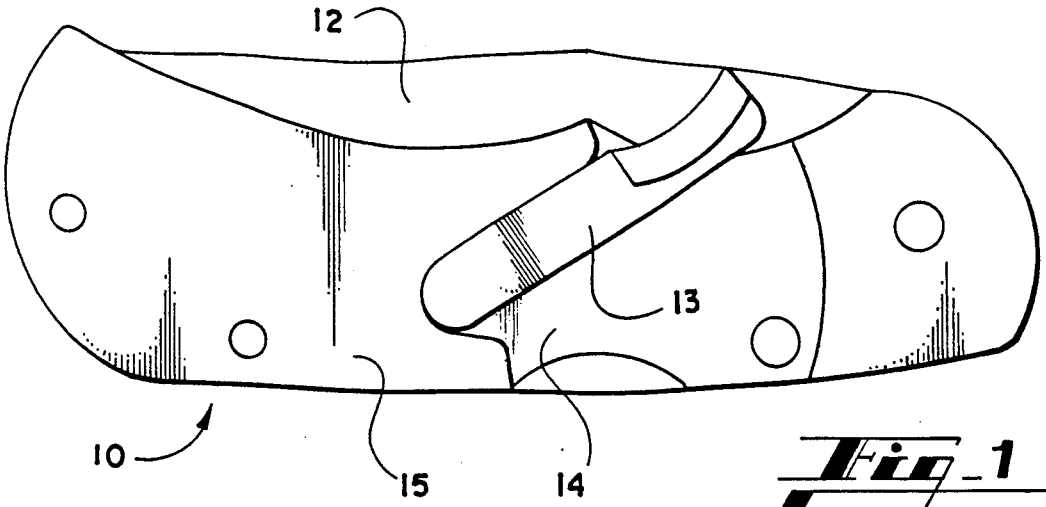
FIG. 1 is a side view of a lever-actuated folding knife according to a preferred first embodiment of the present invention.
Figure 2:
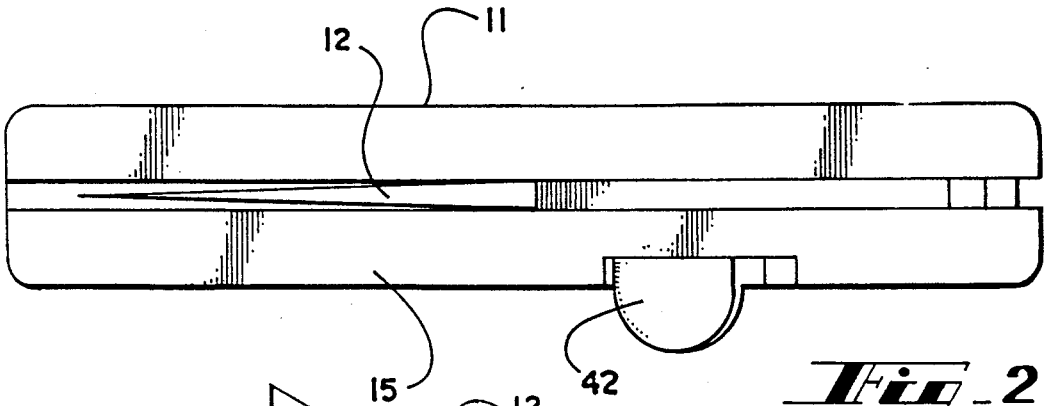
FIG. 2 is a top view of the knife shown in FIG. 1.
Figure 3:
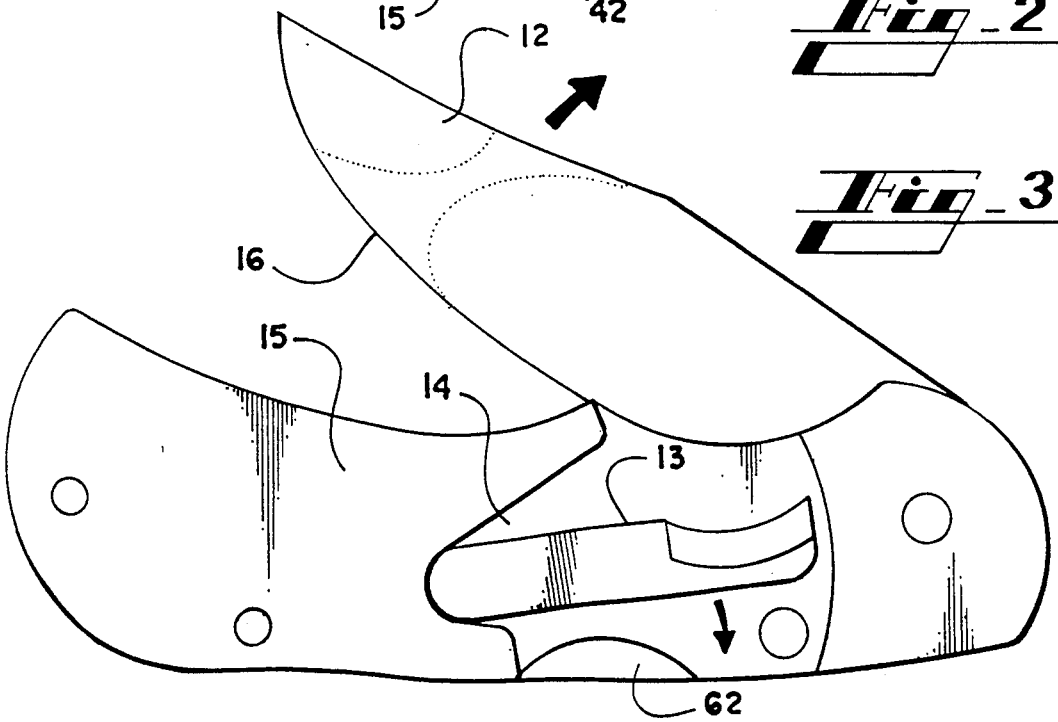
FIG. 3 is a side view as in FIG. 1, showing the knife blade partially opened.

Turning first to FIGS. 1–3, there is shown generally at 10 a lever-actuated folding knife having a body 11 within which a blade 12 is pivotably attached. The blade 12 is movable between a closed position shown in FIG. 1, and a fully-opened position in which the blade is rotated nearly 180° to extend substantially parallel with the longitudinal axis of the body 11. The blade is selectably moved from closed position to opened position by means of the actuation lever 13, and FIG. 3 shows the blade moved part way from closed to opened positions in response to partial downwardly travel of the actuation lever. This actuation lever 13 is mounted in a recessed region 14 of the front body member 15 making up the body 11 of the knife. Although the blade 12 is shown as having a conventional sharpened edge 16 along one side thereof, it should be understood that the term "blade" as used herein is meant to include any generally elongated tool or implement suitable for pivotable mounting within a body or housing.

Figure 4:
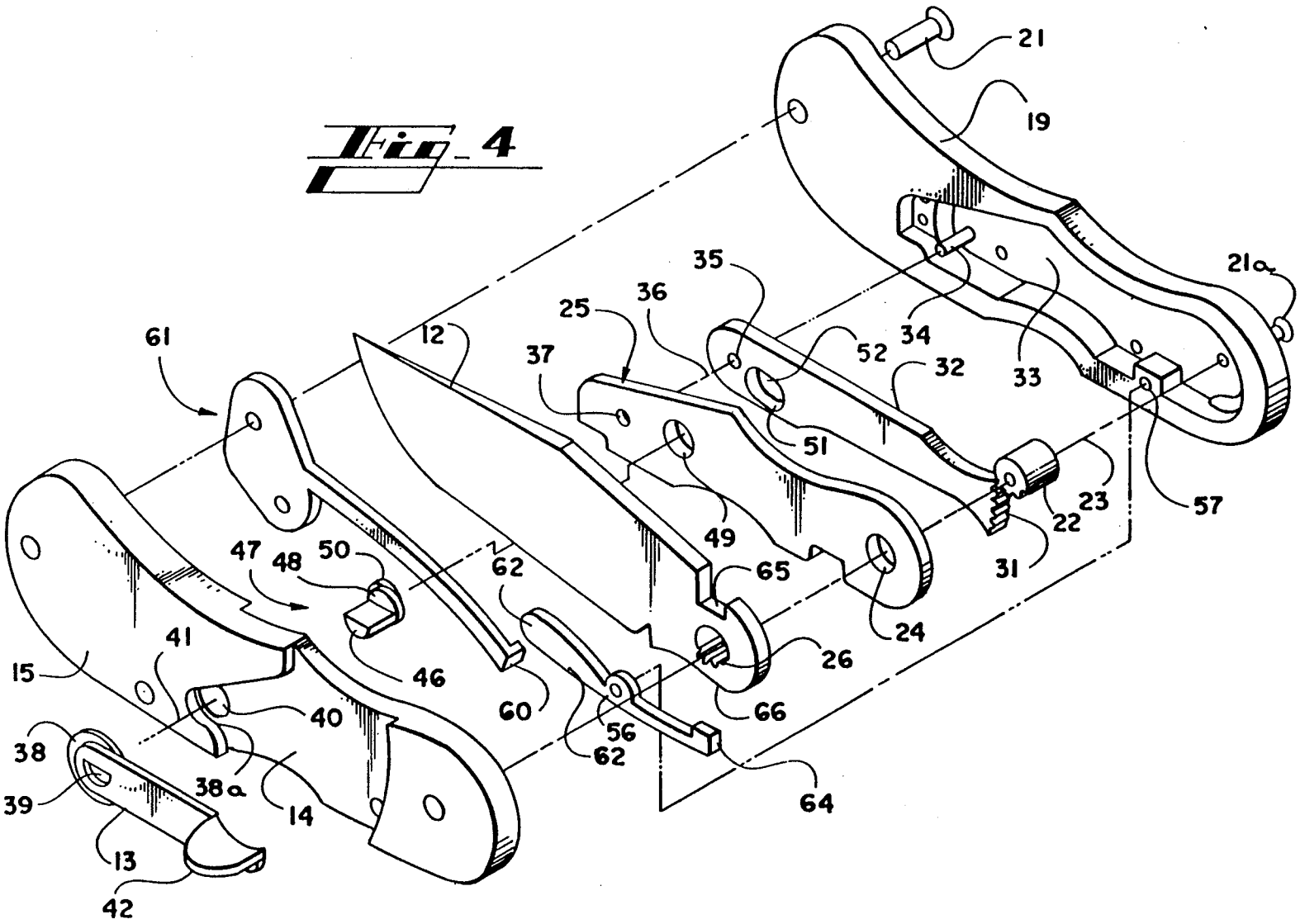
FIG. 4 is an exploded view of the knife shown in FIG. 1.
Figure 7:
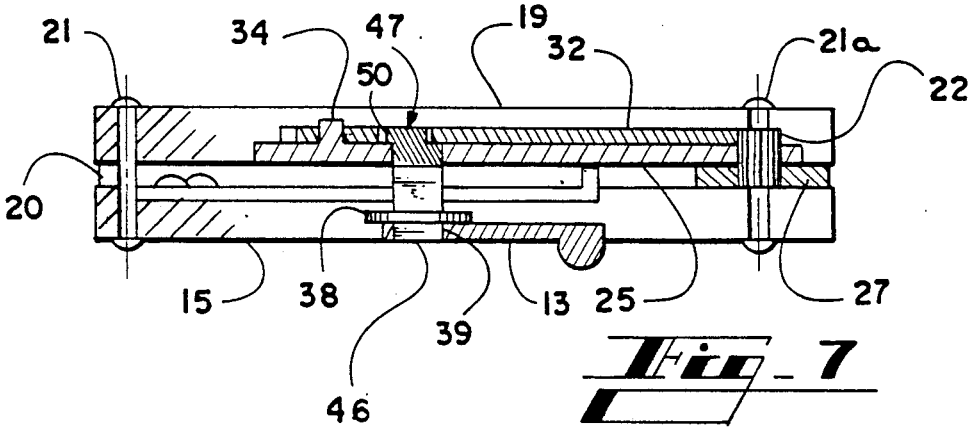
FIG. 7 is a partially broken-away sectioned top view of the knife shown in FIG. 1.

Individual components of the knife 10 and the physical interrelation of those components are best understood with reference to the exploded view of FIG. 4 and the section view of FIG. 7. Turning first to FIG. 4, the body 11 of the knife comprises the aforementioned front body member 15 and a back body member 19 that are secured together in assembly by fasteners such as rivets 21 or the like. A spacer portion 20 maintains proper spacing between the front and back body members, at the end opposite the blade 12. The rivet **21*a* extends through an axial opening in the blade drive gear or pinion 22 so that the blade drive gear is pivotable on an axis 23 concentric to that rivet. The blade drive gear 22, in turn, extends freely through the opening 24 at one end of the cover subplate 25 and engages the toothed opening 26 formed at the tang end of the blade 12. The blade opening 26 is toothed to provide positive engagement with the blade drive gear 22 within that opening. The blade 12 in FIG. 7 is shown extending out of the drawing plane and pointed toward the viewer, so that only the tang 27** of the blade appears in that figure.

The blade drive gear 22 engages the gear teeth 31 constituting a sector gear formed at one end of a blade opening lever 32. This blade opening lever is received within an interior recess 33 formed in the inwardly-facing side of the back body member 19.

The blade opening lever 32 is retained within the recess 33 by a cover subplate 25. A pin 34 protrudes outwardly from the inward side of the cover subplate and freely extends through a mating opening 35 formed near the end of the blade opening lever 32 remote from the gear teeth 31. The free end of the pin 34 fits in the opening 37 in the cover subplate 25, locating the cover subplate in place over the recess 33. The blade opening lever 32, although retained within the recess 33 of the back body member 19, is free to pivot about the pin 34 on an axis 36 in an arc of movement within that recess.

The actuation lever 13 has a flange 38 formed at an inner end, and that flange slides into a slot 38*a* at one end of the recessed region 14 in the front body member 15. A D-shaped opening 39 in the inner end of the actuation lever 13 is aligned with an opening 40 adjacent one end of the recessed region 14 in the front body member 15. The actuation lever 13 thus can pivot back and forth within the recessed region 14, on an axis 41 shown in FIG. 4. A thumb engaging member 42 protrudes outwardly from the end of the actuation lever 13 opposite the inner end, in position for ready engagement by the thumb of a person holding the knife.

The D-shaped opening 39 of the actuation lever 13 receives a mating axial end of the shaft 46 formed on a cam member 47 disposed on the interior side of the front body member 15. This cam member 47 has a cylindrical portion 48 coaxial with the axis 41 and pivotably located within an opening 49 extending through the cover subplate 25 in spaced-apart relation to the opening 24 therein. The shaft extension 47 further has a cam portion 50 on the end of the cylindrical portion 48 remote from the protrusion 46, and this cam portion 50 extends into an opening 51 formed in the blade opening lever 32 adjacent the axis of rotation 36. The opening 51 is generally oblong in shape, and the surface of that opening defines a cam track 52 against which the cam portion 50 bears.

The knife 10 includes a blade lock lever 56 (FIG. 4) pivotably mounted on a rivet extending between the opening 57 in the back body member 19 and a confronting opening on the facing side of the front body member 15. The curved end portion 60 of a beam spring 61 bears against the underside of the blade lock lever portion 62, urging the blade lock lever 56 in the counterclockwise direction (as seen in FIG. 4) so that the squared locking member 64 at the opposite end of the lever 56 is urged into locking engagement with a squared notch 65 formed in the tang end of the blade 12, when that blade is pivoted to the full-opened position.

Figure 5:
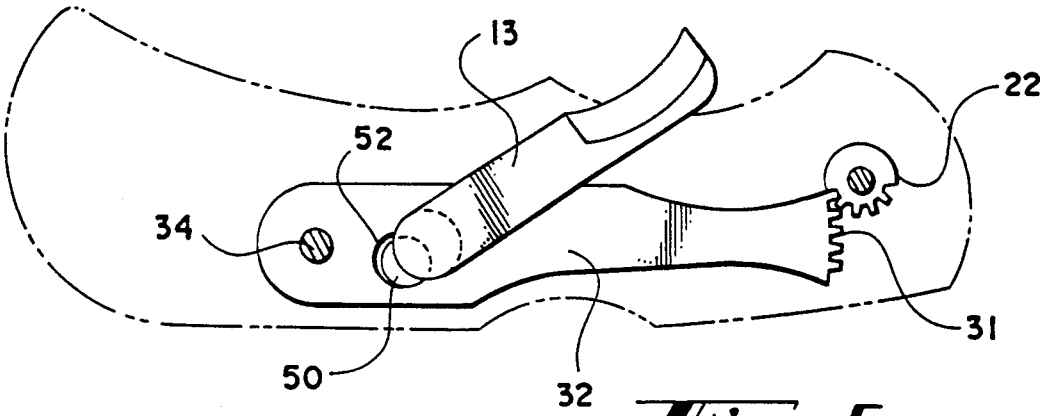
FIG. 5 is a cutaway view of the knife shown in FIG. 1, showing the blade operating mechanism in fully-closed position.
Figure 6:
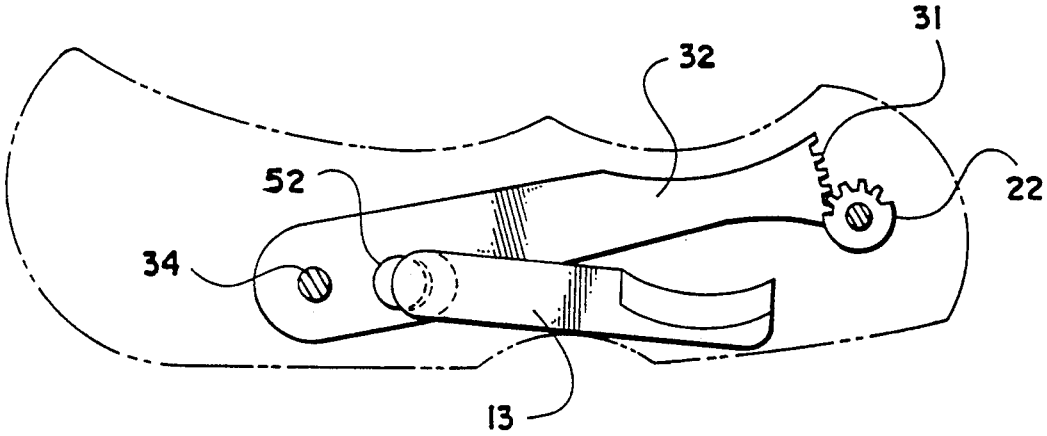
FIG. 6 is a cutaway view as in FIG. 5, with the blade mechanism shown in fully-opened position.

The operation of the knife as disclosed above is now considered, with particular reference given to FIGS. 5 and 6. With the blade in the fully-closed position as seen in FIG. 1, the actuation lever 13 and the blade operating lever 32 each occupy the positions shown in FIG. 5. Although the blade and blade lock lever 56 are omitted from FIG. 5 for clarity of illustration, it will be appreciated that the locking member 64 is spring-biased to contact the flattened underside 66 (FIG. 4) of the blade tang, thereby maintaining the blade in its closed position.

To open the blade, a person holding the knife in his or her hand presses downwardly on the thumb-engaging member 42 protruding outwardly from the free end of the actuation lever 13. The surface of the thumb-engaging member 42 may advantageously be serrated or otherwise roughened to provide a nonslip contact with the thumb. This downward force causes the actuation lever 13 to pivot on the axis 41 (FIG. 4), rotating the shaft 46 and with it the cam member 47. This rotation of the cam member 47 displaces the cam portion 50 within the opening 51 of the blade opening lever 32, thereby moving that cam portion upwardly into contact with the cam track 52 defining the upper extent of that opening. As a result, the cam portion 50 causes the blade opening lever 32 to pivot in a counterclockwise direction, as viewed in FIG. 6, around the pin 34. This pivoting movement of the blade opening lever 32 moves the gear teeth 31 upwardly, imparting a clockwise rotation to the blade drive gear 22 and thereby pivoting the blade away from its closed position within the body 11 of the knife.

FIG. 3 shows the knife with the actuation lever 13 moved part way through its full extent of downward travel, and with the blade 12 having pivoted approximately one-third way from closed to opened positions. Further downward travel of the actuation lever 13 places that lever at its full-downward position as shown in FIG. 6, wherein the full extent of the gear teeth 31 on the blade opening lever 32 have engaged and rotated the blade drive gear 22 to the full-opened position of the blade 12. As the blade arrives at the full-opened position, the locking member 64 of the blade lock lever 56 engages the squared notch 65 on the tang of the blade, locking the blade in the opened position against accidental or unexpected closure.

The knife blade 12 is returned to the closed position by pressing inwardly on the blade lock lever portion 62, overcoming the bias of the beam spring 61 and withdrawing the locking member 64 from the notch 65 on the blade. With the blade thus unlocked, the user can manually return the blade back to the closed position within the body 11 of the knife, and it will be seen that this return movement of the blade causes the blade drive gear 22 to return the blade opening lever 32 to its original position as shown in FIG. 5. The actuation lever 13 also is returned to its original position at this time, as the cam track 52 on the blade opening lever displaces the cam portion 50 and thereby rotates the shaft extension 47 about the axis 41.

It should now be apparent that the disclosed structural and operational interrelation of the blade opening lever and the actuation lever provide a significant mechanical advantage when opening the blade of the knife. This mechanical advantage is most helpful at the beginning of opening, where the resting inertia of the blade must be overcome. The configuration of the cam portion 50 and the mating cam track 52 may be designed to increase this opening torque applied to the blade opening lever 32 during the initial downward travel of the actuation lever 13. With that optional design of the cam arrangement, the mechanical advantage applied by the cam portion becomes relatively lower as the actuation lever is moved further to the full-opened position shown in FIG. 6. However, the need for an increased mechanical advantage is reduced during latter portions of blade travel from closed to opened positions, because the resting inertia of the blade has been overcome and momentum of the blade can be maintained with relatively less torque applied to the blade opening lever 32 by the actuation lever 13.

Turning now to FIGS. 8–11, there is shown a knife indicated generally at 70 and having a body 71 supporting a knife blade 72 selectively opened by a gear or pinion 73 at the pivot point of the knife blade. The blade 72 and gear 73 may be structurally the same as the corresponding elements described in the previous embodiment. The blade drive gear 73 meshes with the gear teeth 74 formed at the periphery of one end of the blade opening lever 75. That lever 75 is pivotably mounted on a support shaft 77 extending outwardly from the bottom of a recess 78 formed in the intermediate plate 79 of the knife. It will understood by those skilled in the art that the intermediate plate 79 is covered on the outer side by a body plate 80 (FIG. 11 ) forming part of the knife body 71.

The blade opening lever 75 is pivotably mounted on the support shaft 77 approximately midway between the geat teeth 74 at the one end of the lever and a drive pin 81 extending perpendicularly from the other end of the lever. That drive pin 81 confronts and coacts with the cam surface 82 formed along one generally-diagonal surface of the slider 83. That slider is captivated between the intermediate plate 79 and the outer plate 80 for sliding movement generally along the longitudinal axis of the knife body 71. The slider 83 is movable between the right-most position shown in FIG. 9 to which the slider is biased by the spring 84, and the left-most position shown in FIG. 10.

Figure 9:
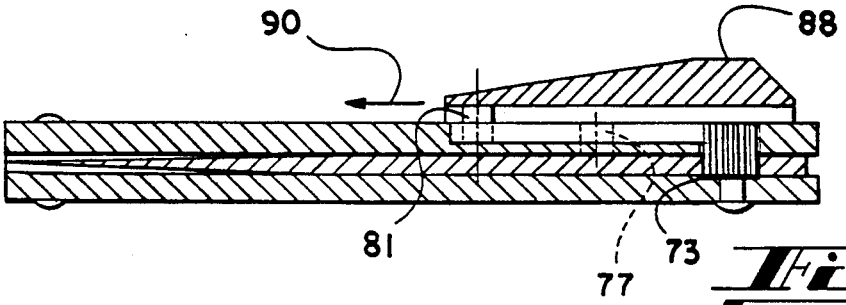
FIG. 9 is a fragmentary sectioned side view of the knife shown in FIG. 8, showing details of the slide button in the unactuated position.
Figure 10:
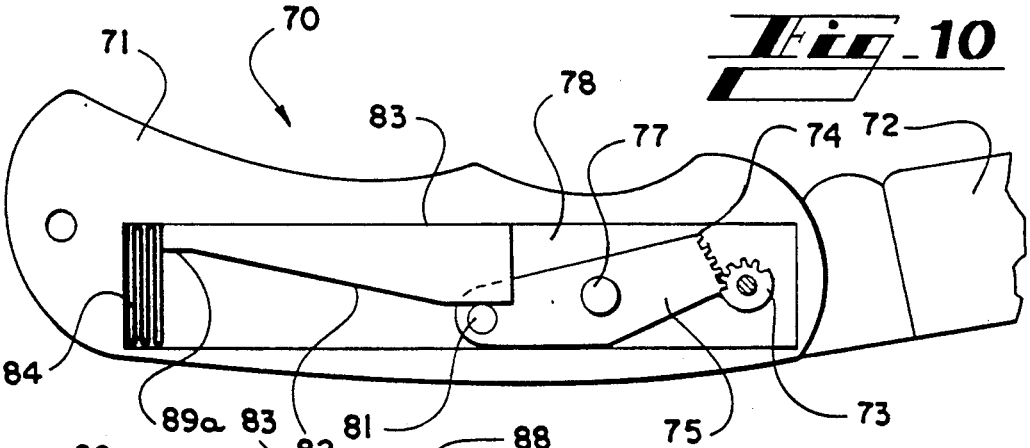
FIG. 10 is a fragmentary cutaway view as in FIG. 8, with the blade shown fully open.
Figure 11:
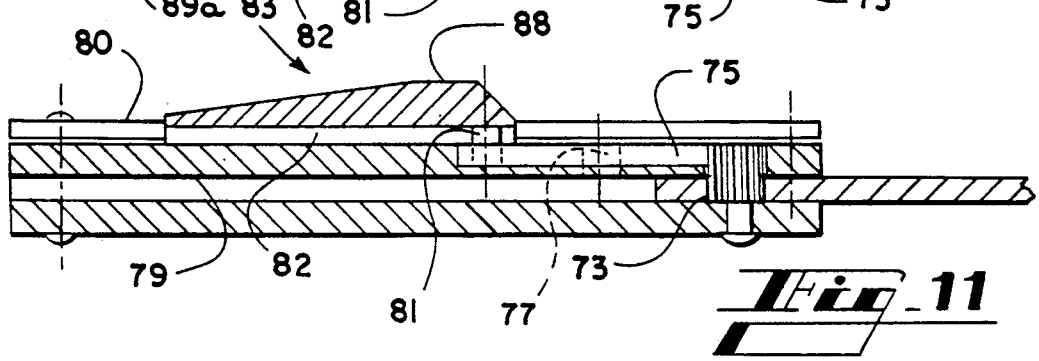
FIG. 11 is a fragmentary view as in FIG. 9, showing the slide button in actuated position to open the blade.

A slide button 88, FIGS. 9 and 11, forms part of the slider 83 and protrudes outwardly beyond the outer plate 80 on one side of the knife, allowing a person holding the knife in one hand to move the slide button towards the rearward position shown in FIG. 10, against the restoring force of the spring 84, by pressing backwardly against the slide button with the thumb of that one hand. The cam surface 82 on the slider 83 in the disclosed embodiment has flat dwell portions 89*a*, 89*b* at the respective ends of the cam track, and these dwell portions provide a resting stop for the drive pin 81 at the extreme ends of travel of the slider.

Figure 8:
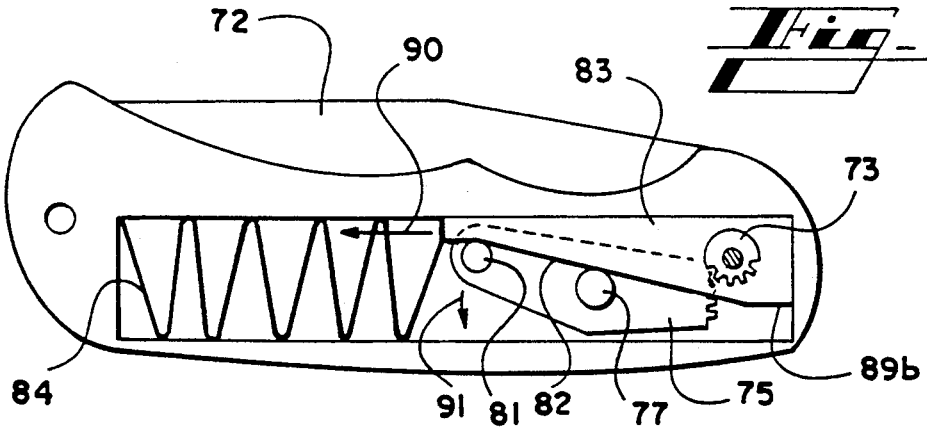
FIG. 8 is a cutaway view in fully-closed position, partially broken away for illustrative purposes, of a lever-actuated folding knife according to a preferred second embodiment of the present invention.

The operation of the embodiment shown in FIGS. 8–11 is now described. With the knife blade 72 in the closed position as shown in FIG. 8, the blade operating lever 75 is in the position shown in FIG. 9 and the spring 84 positions the slider 83 and slide button 88 toward the blade end of the knife. The drive pin 81 associated with the blade operating lever 75 at this time rests at or adjacent the dwell space 89*a* at the left end of the cam surface 82, as viewed in FIG. 8.

A person holding the knife 70 in one hand can open that knife by placing the thumb of that hand on the slide button 88 and sliding that button in the direction shown by the arrow 90 in FIG. 9, that is, away from the blade end of the knife. As the slide button 88 and slider 83 move in the direction shown by arrow 90, the cam surface 82 contacts the drive pin 81 and forces that pin in the direction shown by the arrow 91, FIG. 8, pivoting the blade operating lever 75 in a counter-clockwise direction around the support shaft 77. This pivoting movement of the blade operating lever 75 causes the gear teeth 74 at one end of that lever to rotate the blade drive gear 73 in a clockwise direction, thereby pivoting the knife blade 72 outwardly from the body 71 of the knife. This pivoting outward movement of the knife blade 72 continues as leftward movement of the slider 83 causes the cam surface 82 to move the drive pin 81 to the full-downward position shown in FIG. 10, at which position the drive pin is at or adjacent the dwell surface 89*b* at the other end of the cam surface. It will now be seen that the knife blade 72 has arrived at the full-open position at this time, and the knife blade advantageously may be locked in that open position by a blade lock lever (not shown) of the kind described above with regard to the embodiment of FIGS. 1–7.

Once the knife blade 72 arrives at the full-open position the slide button 88 can be manually released, allowing the spring 84 to return that slide button to the position shown in FIGS. 8 and 9. Of course, the blade operating lever 75 remains in the full-counter-clockwise position shown in FIG. 10 while the knife blade remains open. The knife 70 is closed simply by releasing the blade lock lever, if any, and then manually pivoting the knife blade back to the closed position shown at FIG. 8. This closing movement of knife blade 72 causes the blade drive gear 73 to pivot the blade operating lever 75 in the clockwise direction, returning that lever to the position shown FIG. 8 in readiness for again opening the knife by pressing rearwardly on the slide button 88.

FIG. 8A illustrates a modified version of the embodiment shown in FIGS. 8–11. In FIG. 8A, the modified slider 83*a* has a nonlinear cam surface with a slope at an initial portion 85 less than the linear slope of the cam surface 82 in the unmodified embodiment shown in FIG. 8 so as to provide a relatively increased mechanical advantage as that initial portion of the cam surface displaces the drive pin 81 along an initial extent of sliding movement when the blade is opened. This initial portion 85 of the modified slider 83*a* is followed by a final portion 86 which provides a relative decrease in mechanical advantage at the terminal extent of the cam track. However, it will be understood that relatively less torque is needed to maintain pivoting movement of the knife blade after the standing inertia of the blade has been overcome. Nonlinear cam surfaces other than the particular surface shown in FIG. 8A may also be substituted. It will also be understood that the maximum length of the cam surface, which is determined by the overall length of the knife itself, also affects the slope and mechanical advantage of the cam.

A third embodiment of the present invention is shown in FIGS. 12–15. In that third embodiment, a knife shown generally at 95 has a blade 96 mounted to pivot around the pin 105 on an axis adjacent one end of the body as the blade moves between open and closed positions. A blade drive gear or pinion 98 is coaxial with the pivot axis of the knife blade 96 and pivots with the knife blade. The blade 96 is locked in the open position by a mechanism of the kind shown in the embodiment of FIGS. 1–7, and a blade lock lever 99 biased by the free ends of the leaf spring 100 is manually operated to unlock the knife blade for closing the knife. The other end of the leaf spring 100 fits in the slot 101 formed in the side piece 107.

Figure 13:
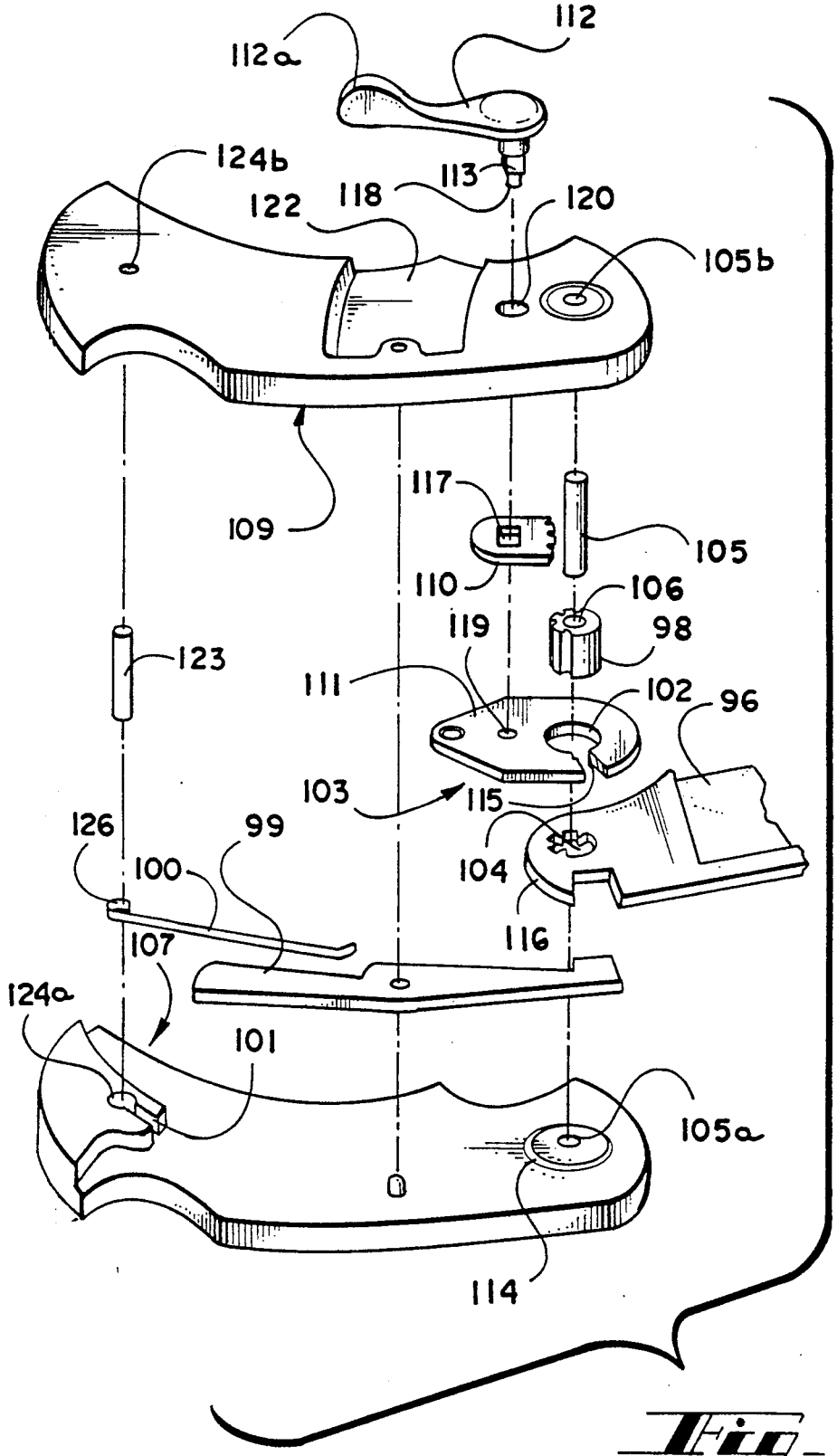
FIG. 13 is a fragmentary exploded view of the knife in FIG. 12, with the blade open.

The blade drive gear 98, similar to the gear 22 described above with respect to FIG. 4, is elongated in thickness and extends freely through the opening 102 in the plate 103 at the blade end of the knife 95 to engage the toothed opening 104 formed at the tang end 116 of the blade 96. The blade drive gear 98 preferably is toothed only along the arc of rotation corresponding to movement of the blade 96 between open and closed positions. The pin 105 fits within an axial opening 106 in the blade drive gear 98 and extends from one end of that gear to enter the aligned openings 105*a* and 105*b* in the side pieces 107 and 109 of the knife, thereby defining the axis of rotation for the blade 96. The plate 103 is located in the recess 108 (FIG. 14) formed on the inner side of the side piece 109. The inner face of the side piece 107 is embossed outwardly at 114 in a circular region surrounding the opening 105*a*, as shown in FIGS. 13 and 14. The side of the plate 103 facing the tang 104 likewise is embossed outwardly at 115 in a circular region surrounding the opening 102 in the plate. These embossed regions 114 and 115 contact the tang 116 of the blade 96 and provide bearing surfaces for the blade, thereby keeping the remaining portions of the blade out of contact with the side pieces 107 and 109 so as to reduce frictional resistance to rotation of the blade.

The blade drive gear 98 meshes with a blade operating gear 110 located on the side 111 of the plate 103. The blade operating gear 110 is preferably a gear segment having teeth meshing with the blade drive gear 98 and extending only along an arc segment substantially coextensive with the arc of travel required to pivot the blade drive gear and the knife blade 96 between the closed position shown in FIG. 12 and the open position shown in FIG. 15. The absence of teeth on the blade operating gear 110 beyond that arc segment permits a relatively small blade operating gear which fits above the plate 103. The blade operating gear 110 may optionally have a blank area at either or both ends of the teeth to prevent travel beyond the opened and closed positions of the knife blade.

The blade operating gear 110 is connected to the opening lever 112 on the outside of the side piece 109 by the square shank 113 extending through an opening 120 in the side piece and engaging the mating square opening 117 in the blade operating gear. A round pin portion 118 extends out from the end of the shank 113 and fits within the hole 119 in the plate 103 to provide added support. The opening lever 112 itself pivots within the recess 122 formed on the exterior surface of the side piece 109. A pin 123 extends through the aligned holes 124*a*, 124*b* in the side pieces 107, 109 and through the loop 126 formed in the spring 100 to hold those elements in assembly. The outer end 112*a* of the opening lever 112 is splayed and preferably is knurled or otherwise provided with a roughened surface for improved manipulation by the thumb of a user.

The operation of the knife 95 is now described. With the knife in its closed position as shown in FIG. 12, a person holding that knife in the palm of one hand can open the knife by placing the thumb of that hand on the splayed end 112*a* of the opening lever 112 and moving the thumb inwardly toward the palm, thereby rotating the lever 112 in a counter-clockwise direction as indicated by the arrow 112*b*, FIG. 12. This force applied to the opening lever 112 rotates the attached blade operating gear 110 in the counter-clockwise direction, thereby rotating the blade drive gear 98 in the clockwise direction and pivoting the knife blade 96 out of the body 97. This pivoting movement of the knife blade continues until the knife blade reaches the full-opened position shown in FIG. 15. During this movement the opening lever 112 is moved toward the back edge 121 of the knife body 97, but that opening lever still remains within the plan view outline of the knife body as seen in FIG. 15. The knife blade 96 thus is moved from closed to open positions by the application of thumb pressure on the outer end of the opening lever 112, without requiring two hands to hold the knife body while manipulating the blade or a blade-opening mechanism. Because the opening lever 112 remains within the outline of the knife body 97 whether the knife is closed as shown in FIG. 12 or open as in FIG. 15, the knife 95 provides a relatively compact configuration while leaving the opening lever available at all times for easy grasping and manipulation.

The blade 96 is returned to the closed position by pressing inwardly on the blade lock lever 99, overcoming the bias of the spring 100 and unlocking the blade in a manner similar to that as described above with regard to the embodiment shown in FIGS. 1–7. As the blade 96 is manually returned to the closed position, the blade drive gear 98 returns the blade opening lever 112 to its original position as shown in FIG. 12.

The knife embodiment shown in FIGS. 12–15 can be modified to provide a relatively greater mechanical advantage between the opening lever 112 and the knife blade 96 during the initial movement of the handle and knife blade. One example of such a modification is shown schematically in FIG. 12A, wherein the blade operating gear 110*a* is a segment of an elliptical gear whose variable radius is relatively less at the position where the knife blade 96 is in the closed position shown in that Figure. The blade drive gear 98*a* is a segment of a mating elliptical gear whose effective radius is relatively great at the position shown in FIG. 12A, where the knife blade 96 is closed. As the opening lever 112 is manipulated to move the gear segment of the elliptical blade operating gear 110*a* counterclockwise to rotate the knife blade toward the open position, the variable radius of the elliptical blade operating gear segment 110*a* increases and the variable radius of the blade drive gear 98*a* correspondingly decreases so that the variable mechanical advantage is reduced while increasing the angular movement of the knife blade 96 for a given rotation of the opening lever 112.

It should also be understood that the foregoing relates only to a preferred embodiment of the present invention, and that numerous changes and modifications thereto may be made without departing from the spirit and scope of the invention as defined in the following claims.

I claim:

1. A folding knife having a body and comprising:

a knife blade mounted in the body for pivotable movement between a closed position and an opened position;

a blade opening lever mounted for movement on a first axis relative to the body and operatively interconnected with the blade so that movement of the blade opening lever over a predetermined arc moves the blade between the closed and opened positions;

a manual actuation lever selectively movable on a second axis relative to the body;

means operatively interconnecting the manual actuation lever with the blade opening lever so as to move the blade opening lever on the predetermined arc in a direction to move the blade from closed to opened position, in response to predetermined manual actuation of the actuation lever;

the manual actuation lever being pivotable on the second axis; and the interconnecting means moving the blade opening lever over the predetermined arc in response to pivoting movement of the manual actuation lever.

2. The knife as in claim 1, wherein:

the interconnecting means comprises a cam engaging a cam track operatively associated with the blade opening lever and movable along the cam track to move the blade opening lever on the predetermined arc.

3. The knife as in claim 2, wherein:

the cam moves within an opening formed in the blade operating lever;

and a surface defining that opening also comprises the cam track.

4. The knife as in claim 2, wherein:

the cam comprises a bearing portion journaled in the body for rotation, and an eccentric portion engaging the cam track to move the blade operating lever as the bearing portion is rotated.

5. The knife as in claim 5, wherein the bearing portion is coaxial with the second axis and turns thereon in response to pivoting movement of the actuation lever.

6. The knife as in claim 2, wherein:

the cam track associated with the blade opening lever is located between the first axis and the operative interconnection with the blade.

7. The knife as in claim 2, wherein:

the actuation lever includes an engagement member spaced apart a predetermined distance from the second axis and positioned for engagement by the thumb of a person holding the body; and the cam is spaced apart from the second axis a lesser distance than said predetermined spacing of the engagement member, so as to give a mechanical advantage to the cam when moving the blade opening lever in response to movement of the actuation lever by manual force exerted on the engagement member.

8. The knife as in claim 1, wherein the operative interconnection between the blade and the blade opening lever comprises:

a blade drive gear in driving relation to the blade; and gear teeth operatively associated with the blade opening lever and operatively engaging the blade drive gear, so that the gear teeth engage and rotate the blade drive gear to move the blade from closed to opened position as the opening lever moves on the predetermined arc.

9. The knife as in claim 1, wherein:

the actuation lever comprises a member supported for movement along a linear path relative to the body as the blade opening lever is moved on the predetermined arc.

10. The knife as in claim 9, wherein:

the interconnecting means comprises a cam track operatively associated with the actuation lever and engaging a follower member operatively associated with the blade opening lever.

11. The knife as in claim 9, wherein:

the interconnecting means comprises an incline operatively associated with one of the blade opening lever and the actuation lever, and a follower operatively associated with the other of the blade opening lever and the actuation lever for engagement by the incline as the actuation lever is selectively moved along the linear path, so that the blade opening lever is pivoted to move the blade from closed to open position in response to the selective movement of the actuation lever.

12. The knife as in claim 1, wherein:

the blade opening lever is pivotably mounted in the body and has gear teeth operatively associated with a gear connected in driving relation to the blade;

the actuation lever is supported for sliding movement on a predetermined path and has a surface positioned for engagement by the thumb of a person holding the knife body in one hand; and the interconnecting means comprises a surface inclined to the predetermined path and a member coacting with the inclined surface as the actuation lever is moved in a selected direction along the predetermined path, so that the coaction between the member and the inclined surface pivots the blade opening lever to move the blade from closed to open position.

13. The knife as in claim 12, wherein:

the incline of the surface is nonlinear in relation to the predetermined path so that a certain amount of said coaction at an initial portion of sliding movement of the actuation lever causes relatively less pivoting movement of the blade opening lever than the same amount of coaction at a subsequent portion of the sliding movement, whereby the mechanical advantage imparted to open the knife blade is relatively greater at the beginning of opening to overcome the resting inertia of the blade.

14. A folding knife having a body and comprising:

a knife blade mounted in the body for pivotable movement on a first axis between full closed and full open positions;

a driven member operatively connected to the knife blade;

a drive member supported in the body for pivotable movement on a second axis and in driving relation to the driven member;

a manual actuation lever pivotably mounted on the body and selectively operative to rotate the drive member, so as to pivot the knife blade from the full closed position to the full open position; and the actuation lever is disposed outside the body for engagement between the thumb and palm of a hand so that the actuation lever can be pivoted by thumb pressure, whereby the knife blade can be opened to the full open with only that one hand.

15. The knife as in claim 14, wherein the drive member has nonlinear means operative to impart a nonuniform pivoting movement of the driven member in response to uniform movement of the drive member, whereby the mechanical advantage imparted to open the knife blade is relatively greater at the beginning to overcome the resting inertia of the blade.

16. The knife as in claim 14, wherein:

the manual actuation lever is mounted for said pivotable movement in a recess formed on an exterior surface of the body.

17. A folding knife having a body and comprising:

a knife blade mounted in the body for pivotable movement on a first axis between closed and open positions;

a driven member operatively connected to the knife blade;

a drive member supported in the body for pivotable movement on a second axis and in driving relation to the driven member;

a manual actuation lever pivotably mounted on the body for engagement between the thumb and palm of a hand so that the lever can be pivoted by thumb pressure and operative to rotate the drive member, so as to pivot the knife blade from the closed position to the open position;

the driven member comprises a pinion; and the drive member comprises a gear segment having teeth meshing with the pinion and extending on a segment arc substantially only coextensive with the arc of travel required to pivot the knife blade between closed and open positions;

whereby the absence of teeth beyond the segment arc prevents moving the pinion and gear segment therebeyond.

18. A folding knife having a body and comprising:

a knife blade mounted in the body for pivotable movement between a closed position and an opened position;

a blade opening lever mounted for movement on a first axis relative to the body and operatively interconnected with the blade so that movement of the blade opening lever over a predetermined arc moves the blade between the closed and opened positions;

a manual actuation member selectively movable on a linear path relative to the body as the blade opening lever moves on the predetermined arc;

a slidable member operatively associated with the manual actuation member and having a cam surface;

a follower engaging the cam surface for displacement in response to sliding movement of the slidable member by the manual actuation member; and the follower being operatively interconnected with the blade opening lever so as to move the blade opening lever on the predetermined arc from the closed to the opened positions, in response to predetermined manual actuation of the actuation member.

* * * * *